United States Patent [19]

Pousette et al.

[11] 4,425,951

[45] Jan. 17, 1984

[54] HOLLOW DEBARKING ARM

[75] Inventors: Ronald D. Pousette, Vancouver; John L. Sanders, North Vancouver, both of Canada

[73] Assignee: Brunette Machine Works, Ltd., New Westminster, Canada

[21] Appl. No.: 349,046

[22] Filed: Feb. 16, 1982

[51] Int. Cl.[3] ..... B27L 1/00

[52] U.S. Cl. ..... 144/208 E; 144/340

[58] Field of Search ..... 144/208 R, 208 E, 241, 144/340

[56] References Cited

U.S. PATENT DOCUMENTS

| | | | |
|---|---|---|---|
| 3,388,750 | 6/1968 | Hamm . | |
| 3,973,607 | 8/1976 | Jonsson . | |
| 4,231,406 | 11/1980 | Jonsson | 144/208 E |
| 4,280,541 | 7/1981 | Reimler et al. | 144/208 E |

*Primary Examiner*—W. D. Bray

*Attorney, Agent, or Firm*—Kolisch, Hartwell & Dickinson

[57] ABSTRACT

A debarking arm for use in a log-debarking apparatus having a ring which is rotatable about a transport axis, as a log is moved along this axis through an opening in the ring in a front-to-rear direction. The arm includes an elongate, curved, substantially closed hollow section extending between an inner end adapted to carry a debarking tip, and an outer end adapted to be mounted on the ring for swinging of the arm's inner end toward and away from the transport axis. The section has a front edge portion which, with the arm is an operative position on the ring, inclines rearwardly progressing toward the inner arm end, and a front wall portion which slopes rearwardly progressing from the front edge portion in a direction away from the transport axis. A curved log-engaging edge projection extends along and projects forwardly from the arm's front edge portion to engage a log during initial log contact.

4 Claims, 4 Drawing Figures

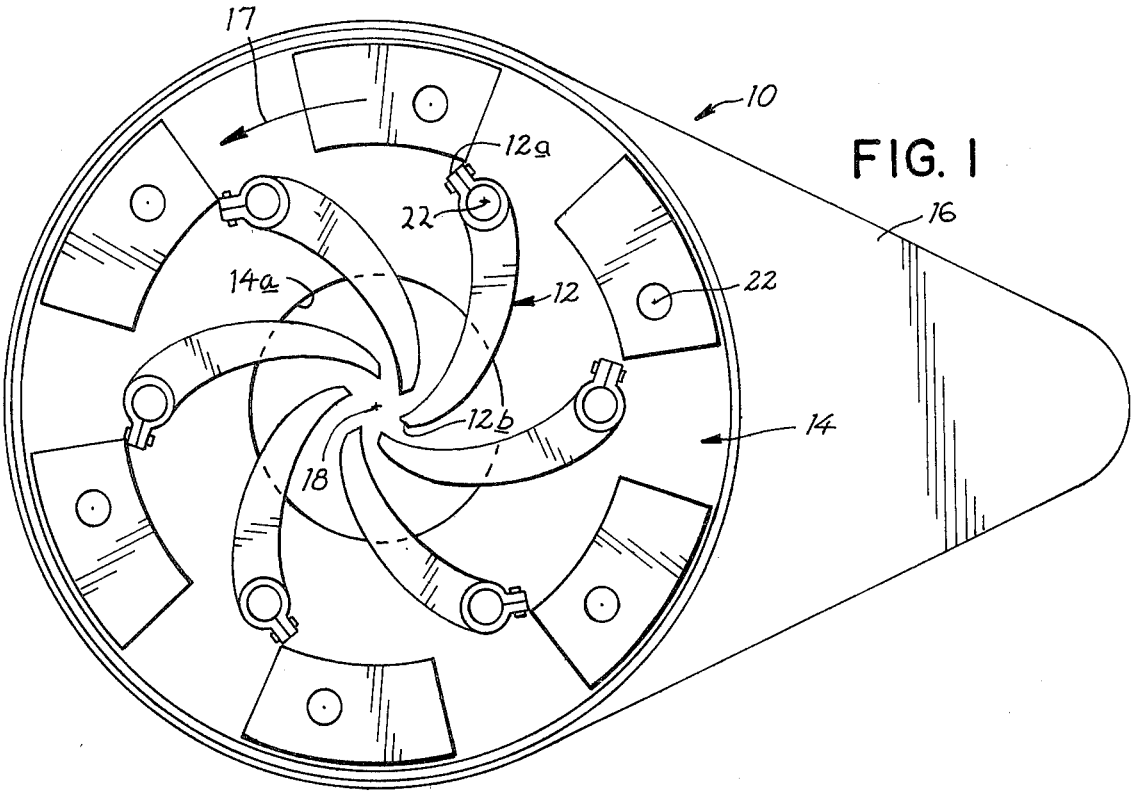
FIG. 1
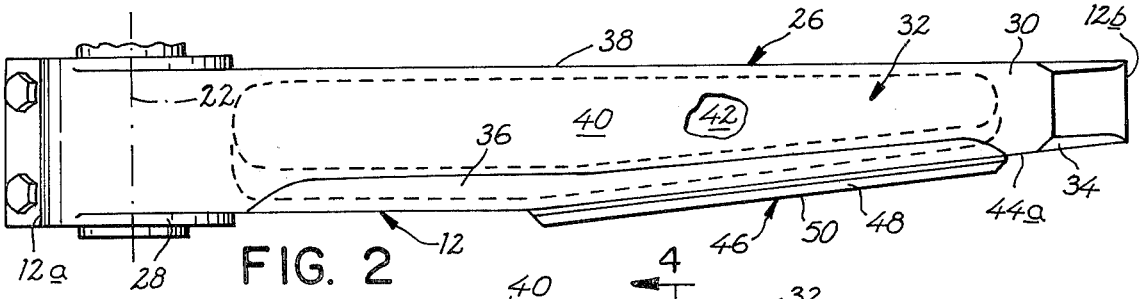
FIG. 2
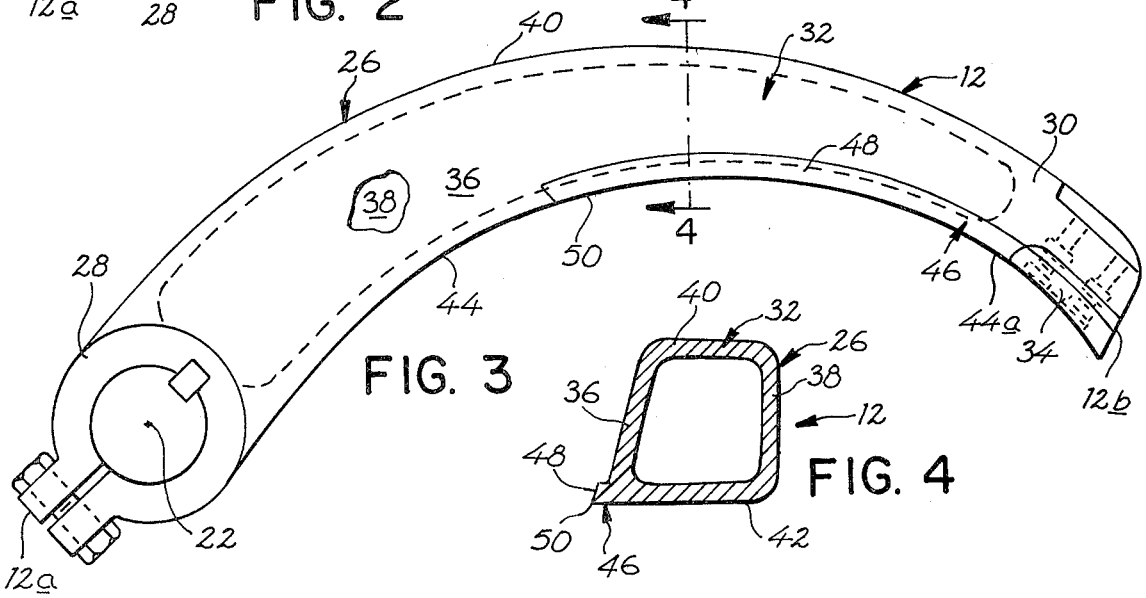
FIG. 3
FIG. 4

HOLLOW DEBARKING ARM

BACKGROUND AND SUMMARY

The present invention relates to an improved debarking arm for use in a log-debarking apparatus.

The usual log-debarking system includes a debarking apparatus having a ring mounted on a support frame for powered rotation about a log-transport axis. Two log-feed assemblies positioned on either side of the apparatus are operable to move a log along this axis through a central opening in the ring in a front-to-rear direction. A plurality of elongate, curved debarking arms are mounted on the ring adjacent their outer ends for swinging of their inner ends toward and away from the transport axis. The arms are normally biased toward inwardly swung positions.

To introduce a log into the apparatus, typically, the log is moved along the transport axis until its front end makes contact with front edge projections extending along front outer end edges of the arms. The combined rotative movement of the arms and the forward movement of the log acts to open the arms—that is, spread the inner arm ends away from the transport axis—to allow log entry into the central opening in the ring. At this point, the surface of the log is embraced by the arms, with debarking tips in the arms being biased against the log surface. Debarking occurs by the action of these tips circulating about the log surface as the log is moved axially in a front-to-rear direction.

It can be appreciated that the debarking arms in such an apparatus may be subjected to extreme forces in the direction of log movement, both by the initial arm-opening event and during the actual debarking operation. The accumulated effect of such forces produces arm fatigue which can damage an arm. Prior art debarking arms generally have a solid, curved bar construction which is quite durable, and which effectively prevents an arm from being damaged by repeated longitudinally directed forces. The solid arm construction, however, adds significantly to the weight of a log-debarking apparatus. Excessive weight is a particularly troublesome problem in that it produces significant centrifugal forces on arms with the debarking ring rotating. Such forces are counterproductive in that they must be overcome in order to create the necessary debarking forces at the arms' debarking tips.

One general object of the present invention is to provide, for use in a log-debarking apparatus of the type described above, a hollow substantially closed, debarking arm which is both lightweight and strong.

A related object of the invention is to provide such an arm having an angled wall portion which serves both to reduce the weight of the arm, and to increase its strength against forces encountered in a log-debarking operation.

Still another object of the invention is to provide such an arm which is interchangeable, in a log-debarking apparatus, with a solid debarking arm of the type known in the prior art.

The debarking arm of the present invention is intended for use in a log-debarking apparatus having a ring which is rotatable about a transport axis as a log is moved along this axis through an opening in the ring in a front-to-rear direction. The arm includes an elongate, curved hollow section extending between an inner end adapted to carry a debarking tip, and an outer end adapted to be mounted on the ring for swinging of the arm's inner end toward and away from the transport axis. The structure has a front edge portion, which, with the arm in an operative position on the ring, inclines rearwardly progressing toward the inner arm end, and a front wall portion which slopes rearwardly progressing from this edge portion in a direction away from the transport axis. A curved log-engaging edge projection extends along and projects forwardly from the arm's edge portion, to engage a log during initial log contact.

These and other objects and features of the present invention will become more fully apparent when the following detailed description of a preferred embodiment of the invention is read in conjunction with the accompanying drawings.

DESCRIPTION OF THE DRAWINGS

FIG. 1 is a simplified front view of a portion of a log-debarking apparatus equipped with debarking arms constructed according to the present invention;

FIG. 2 is an enlarged top view of an arm shown in FIG. 1;

FIG. 3 is a front view of the arm shown in FIG. 2; and

FIG. 4 is a slightly enlarged sectional view taken along line 4—4 in FIG. 2.

DETAILED DESCRIPTION OF A PREFERRED EMBODIMENT OF THE INVENTION

In FIG. 1 there is shown a simplied front view of a log-debarking apparatus 10. A ring 14 in the apparatus is mounted on a support frame 16 for powered rotation, in the direction indicated by arrow 17, about a log-transport axis 18 extending normal to the figure plane. The ring defines a central opening 14*a* concentric with axis 18. The apparatus forms part of a log-debarking system which also includes a pair of log-feed assemblies (not shown) stationed on either side of ring 14 for supporting and advancing a log substantially along axis 18, through opening 14*a* during a log-debarking operation.

Also included in the apparatus is a plurality of debarking arms, such as arm 12, constructed according to the present invention. Arm 12, which is representative, has outer and inner ends 12*a*, 12*b*, respectively. The arms in the apparatus are mounted adjacent their outer ends on ring 14, in a conventional manner, for swinging of their inner ends toward and away from axis 18. The arm's swinging axes, such as axis 22 associated with arm 12, parallel axis 18. Included in apparatus 10, but not shown here, are conventional means used in biasing the debarking arms toward the inwardly swung positions shown in FIG. 1.

Referring now to FIGS. 2 and 3, arm 12 includes an elongate curved structure 26 composed of a ring clamp 28 at the outer (left) arm end in the figures, a tip region 30 at the inner (right) arm end, and an elongate, curved substantially closed hollow section 32 extending between clamp 28 and region 30. Clamp 28 is used in clamping the arm onto a shaft which is journaled on ring 14 in a conventional manner. Tip region 30 is adapted conventionally for carrying a replaceable debarking tip 34.

Section 32 has the hollow, or tubular, construction seen cross-sectionally in FIG. 4. The section is composed of front and back walls, or wall portions, 36, 38, respectively, joined to top and bottom walls 40, 42, respectively. The dashed lines in FIGS. 2 and 3 indicate the inner surfaces of the walls in section 32. In the particular embodiment of the invention described herein, the four walls forming the section have a thickness of about ⅜-inches, where the top-to-bottom dimension of the section, along the section line of FIG. 4, is about four inches. Section 32 is preferably formed of cast steel or the like.

Walls 36, 38, when viewed face on as in FIG. 3, have the general curved shape seen, and converge progressing from the outer toward the inner arm end.

As seen in FIG. 2, the inner portion of a lower edge 44 in wall 36 converges slightly toward wall 38 progressing from a central region in the section toward the arm's inner end. The converging edge portion of edge 44 is designated 44*a* in FIGS. 2 and 3. With arm 12 mounted in operative position in apparatus 10, as in FIG. 1, portion 44*a* may be thought of as inclining rearwardly (in the direction of log movement, which is in a bottom-to-top direction in FIG. 2), progressing toward the inner end of the arm.

According to an important feature of the present invention, and with reference to FIGS. 2 and 4, wall 36 converges toward wall 38 (toward the viewer in FIG. 2, and upwardly in FIG. 4). The angle of wall convergence—that is, the angle which wall 36 forms with the wall's lower extremity in FIG. 4—is about 15°. Thus, wall 36 may be thought of as sloping generally rearwardly (in the direction of log movement along axis 18) progressing from its lower toward its upper edge, while wall 38 lies in a plane substantially normal to this axis. This feature contributes importantly to strength and light-weightness in arm 12.

Completing the description of arm 12, a curved, log-engaging edge projection 46, typically surface-hardened, is formed on wall 36, substantially coextensive with, and projecting forwardly with respect to, edge portion 44*a* in the front wall. Projection 46 has lengthwise curvature as seen in FIG. 3, and an inclined front face 48, as seen sectionally in FIG. 4, forming a curved, log-engaging edge 50. Projection 46 is preferably integrally formed with section 32, as by casting.

In operation, a log is fed by a log-feed assembly (not shown) substantially along axis 18 toward apparatus 10 in a front-to-rear direction (away from the reader in FIG. 1). Prior to the log's contacting the debarking arms on rotating ring 14, the arms are disposed in the inwardly swung positions shown in FIG. 1. The periphery of the front face of the log makes initial contact with the edge projections in the arms. Continued movement of the log in a rearward direction along axis 18 acts on the arms in the rotating ring, in a conventional manner, to swing the inner arm ends away from axis 18 to positions where the log is enbraced by the debarking tips. As the log is advanced through the rotating debarking ring, it is debarked in a conventional manner by the action of the tips.

As noted above, the arms in apparatus 10 may be subject to extreme axially directed forces (in the direction of log movement) both during the initial arm-opening event and during the debarking operation itself. It can be appreciated how the novel construction of the debarking arm of the present invention contributes to its ability to withstand and resist such forces. First, the sloping wall construction in an arm permits forces directed axially against the arm, either through projection 46 or through tip 34, to be "deflected" partially, through wall 36, to the arm's upper wall. Accordingly, a more balanced force condition is produced in the arm, lessening local stresses therein. Secondly, the convexity which is seen to exist in the front wall portion increases the ability of an arm to withstand axially directed forces without bending, particularly forces applied near the center region of the arm, such as occur during initial log contact with the edge projections in the arms.

Another contribution made by the proposed construction is the reduction of the cost and weight of a debarking arm. And, while weight is significantly reduced through using a closed hollow construction, it may, if required, be further reduced by forming plural apertures or cutouts in an arm's wall portions, resulting in a substantially closed hollow construction.

While a preferred embodiment of the invention has been described herein, it is apparent that various changes and modifications may be made without departing from the spirit of the invention.

It is claimed and desired to secure by Letters Patent:

1. In a log-debarking apparatus having a ring which is rotatable about a transport axis, as a log is moved along the axis through an opening in the ring in a front-to-rear direction, an elongate debarking arm having an outer end mounted on said ring for swinging of its inner, bladed and toward and away from said axis, said arm comprising a substantially closed hollow section extending between and joining said ends, said section having a front edge portion which inclines rearwardly progressing toward the inner end of the section, and a front wall portion which slopes rearwardly progressing from said edge portion in a direction away from said transport axis, and a curved log-engaging edge projection extending along and projecting forwardly from said edge portion.

2. A debarking arm for use in a log-debarking apparatus having a ring which is rotatable about a transport axis as a log is moved along the axis through an opening in the ring in a front-to-rear direction, said arm comprising an elongate, curved hollow structure having an inner end adapted to carry a debarking tip, and an outer end adapted to be mounted on said frame for swinging of its inner end toward and away from such a transport axis, said structure being substantially closed intermediate its ends, said structure having a front edge portion which, with the arm in an operative position on such a ring, inclines rearwardly progressing toward said inner end, and a front wall portion which slopes rearwardly progressing from said edge portion in a direction away from such a transport axis, and a curved log-engaging edge projection extending along and projecting forwardly from said edge portion.

3. A debarking arm for use in a log-debarking apparatus having a ring which is rotatable about a transport axis as a log is moved along the axis through an opening in the ring in a front-to-rear direction, said arm comprising an elongate, curved substantially closed hollow structure having an inner end adapted to carry a debarking tip, and an outer end adapted to be mounted on said ring for swinging of its inner end toward and away from such a transport axis, said structure having a front edge portion which, with the arm in an operative position on such a ring, inclines rearwardly progressing toward said inner end, and opposed front and rear wall portions which converge progressing in a direction away from such a transport axis, and a curved log-engaging edge projection extending along and projecting forwardly from said edge portion.

4. The arm of claim 3, wherein said front wall portion progresses rearwardly progressing from said edge portion in a direction away from such a transport axis, and said rear wall portion lies in a plane substantially normal to such axis.

* * * * *